United States Patent [19]

Taylor

[11] Patent Number: 4,773,563

[45] Date of Patent: Sep. 27, 1988

[54] COFFEE DISPENSING APPARATUS

[76] Inventor: Michael S. Taylor, 158 Sunset View Ct., Ventura, Calif. 93003

[21] Appl. No.: 14,263

[22] Filed: Feb. 12, 1987

[51] Int. Cl.[4] ..... B67D 5/60

[52] U.S. Cl. ..... 222/144.5; 222/472; 222/556; 222/23

[58] Field of Search ..... 222/144.5, 142.2, 142.9, 222/142.3, 470, 472, 557, 549, 129, 142.1, 556, 548, 23; 220/94 B, 23.4

[56] References Cited

U.S. PATENT DOCUMENTS

| | | | |
|---|---|---|---|
| 1,375,929 | 4/1921 | Peters | 222/142.9 |
| 1,440,387 | 1/1923 | Hergenreder et al. | 222/142.2 |
| 2,349,724 | 5/1944 | Henderson | 222/144.5 |
| 2,431,543 | 11/1947 | Collins | 222/144.5 |
| 2,890,816 | 6/1959 | Horland | 222/142.9 |
| 3,212,686 | 10/1965 | DiPierro et al. | 222/472 |
| 3,235,130 | 2/1966 | Walther et al. | 222/142.9 |
| 4,651,900 | 3/1987 | Horvath et al. | 222/144.5 |

*Primary Examiner*—Joseph J. Rolla
*Assistant Examiner*—Kenneth Noland
*Attorney, Agent, or Firm*—Jack C. Munro

[57] ABSTRACT

A dispensing apparatus which incorporates two separate containers. One container is designed to contain one particular type of liquid with the second container to contain a second type of liquid. These containers are connected together into a single unit with therebeing incorporated a manually operated valve member to be moved to either dispense the contents of the first container or the contents of the second container. The valve member is mounted within a housing which includes a spout to direct the contents during dispensing to a particular exterior location. A handle is mounted in conjunction with the dispensing apparatus to facilitate manual carrying and dispensing of the contents of the first and second containers.

1 Claim, 3 Drawing Sheets

COFFEE DISPENSING APPARATUS

BACKGROUND OF THE INVENTION

The field of this invention relates to dispensing equipment and more particularly to a dispensing apparatus for selectively dispensing either one type of liquid or another type of liquid. Both types of liquids are contained within containers formed within a single dispensing apparatus.

Although the subject matter of this invention has been found to be particularly useful in conjunction with the dispensing of coffee, it is considered to be within the scope of this invention that the apparatus could be utilized to dispense other types of liquids, consumable or non-consumable.

Within restaurants, it is a common occurrence to dispense coffee from containers of various sizes and shapes. There are two types of coffee that are being regularly dispensed, that being "regular or caffeinated" coffee and "decaffeinated" coffee. Generally, the server is required to carry a dispenser for caffeinated coffee and a separate dispenser for decaffeintated coffee. This means that the server has one dispenser in one hand and the second dispenser in the second hand making it impossible for the server to complete any other functions such as serve food or remove dishes from a table.

It the two separate coffee dispensers could be incorporated into a single dispensing unit, and that unit could be held by one hand of the server, this would leave free the other hand of the server to perform other functions such as serve food or remove plates and the like. This type of a coffee dispensing device would be more desirable since it would be more efficient as it would leave the server free to form other tasks at the same time as dispensing coffee.

SUMMARY OF THE INVENTION

The structure of the present invention is directed to a coffee dispensing apparatus which utilizes a pair of containers. Within one of the containers there is located caffeinated coffee and in the other container is located a decaffeinated coffee. Each of the containers are identical and located in a reversed substantially abutting relationship in respect to each other. These containers are connected together by a surrounding band into a single unit. A wall member is fixedly mounted to the surrounding band and is positioned between the containers and is to function to separate the containers. A handle is attached to the band and is adapted to be grasped by a human being to facilitate movement of the dispensing apparatus from one location to another. Removably threadably engaged with the band is a valve housing. Within the valve housing is located a manually movable valve member. This valve member is movable so as to only permit dispensing of the contents of one container at a time. The valve housing includes a spout for directing of the dispensed contents to a desired location such as within a coffee cup. The band will normally include some form of obervable indicia to differentiate one container from the other container.

The primary objective of the present invention is to construct a single unit liquid dispensing apparatus which facilitates the dispensing of either one liquid or another liquid from the dispensing apparatus with the dispensing apparatus being supported by one hand of the user.

Another objective of the dispensing apparatus of the present invention is to construct a dispensing apparatus to be of few parts and simple in construction so as to therefore minimize its manufacturing cost.

DETAILED DESCRIPTION OF THE SHOWN EMBODIMENT

Figure 1:
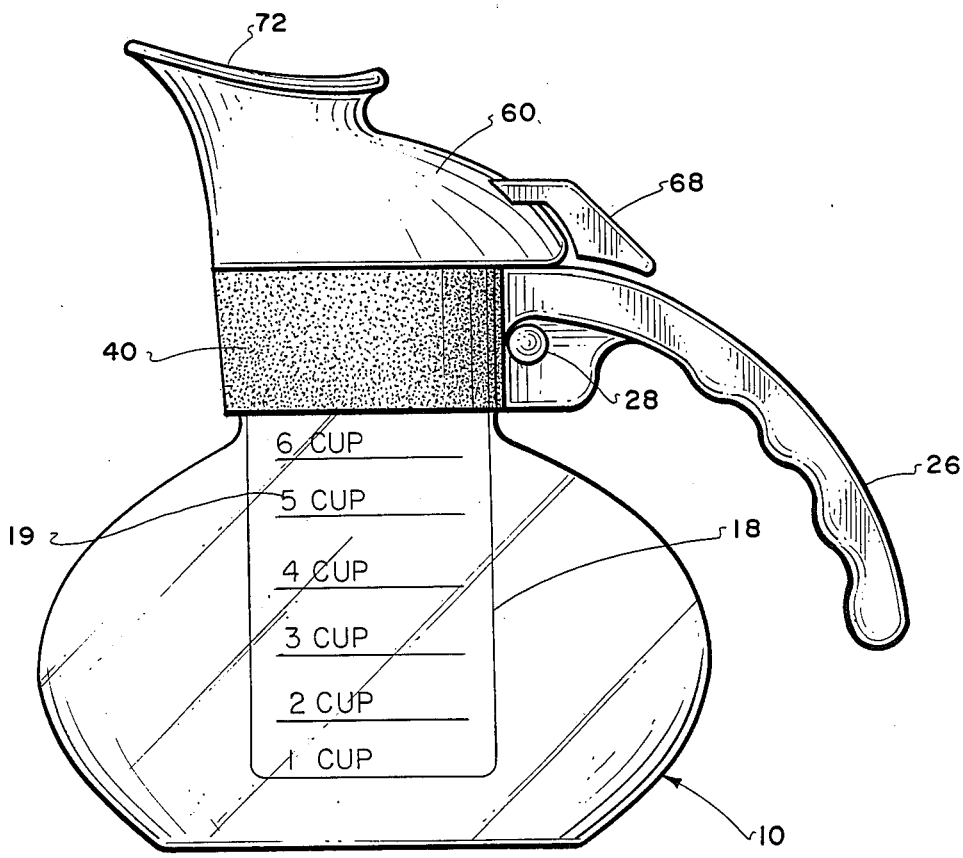
FIG. 1 is a side elevational view of the dispensing apparatus of the present invention showing the dispensing apparatus in the non-dispensing position.
Figure 2:
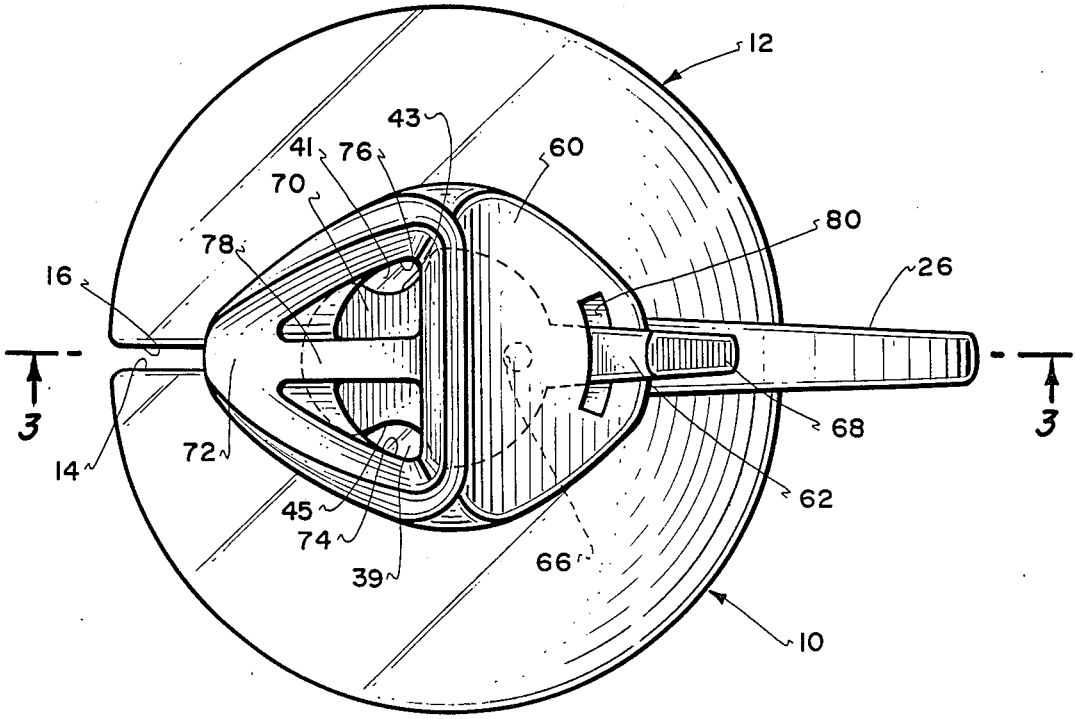
FIG. 2 is a top plan view of the dispensing apparatus of the present invention.
Figure 3:
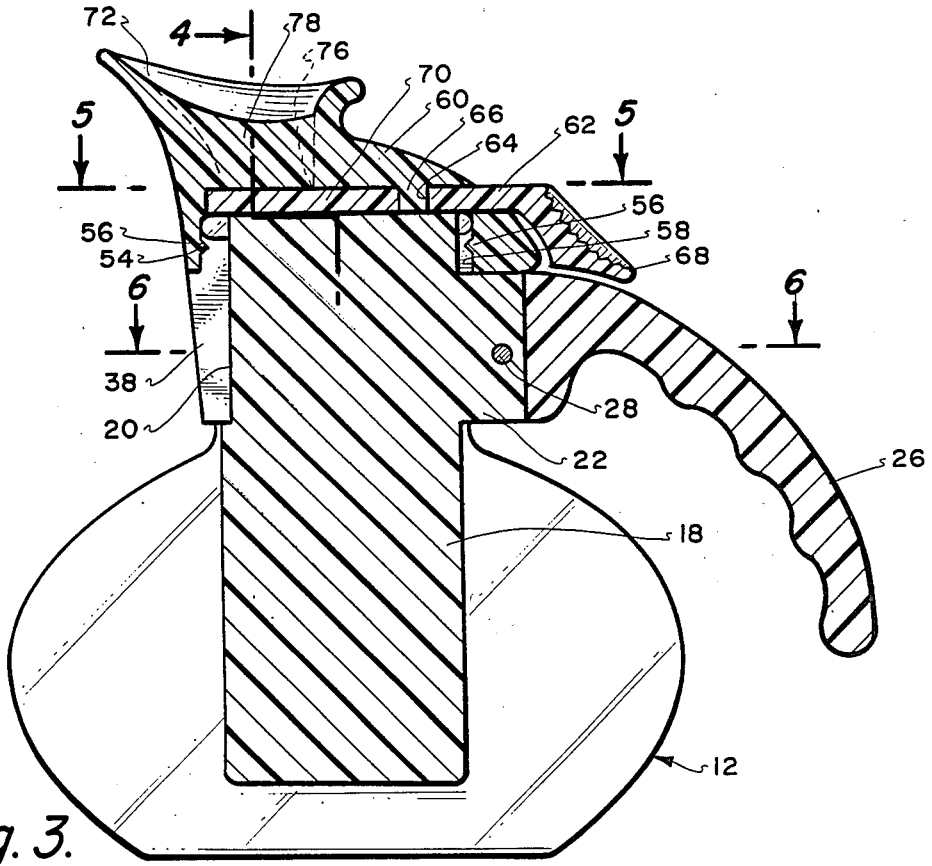
FIG. 3 is a cross-sectional view of the dispensing apparatus of the present invention taken along line 3—3 of FIG. 2.
Figure 4:
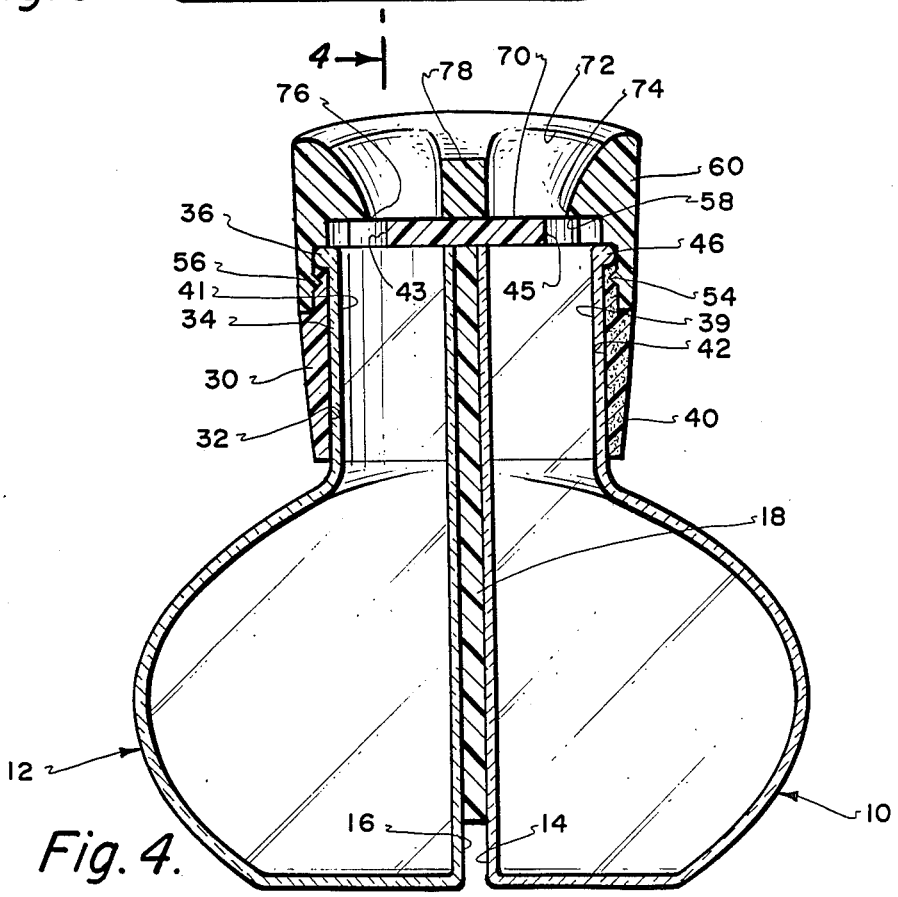
FIG. 4 is a cross-sectional view of the dispensing apparatus of the present invention taken along line 4—4 of FIG. 3.

Referring particularly to the drawings there is shown a first glass container 10 and a second class container 12. While it is common to construct such containers of glass, it is considered to be within the scope of this invention that other materials of construction could be utilized such as plastic. The containers 10 and 12 are identical in construction but located in a reverse facing relationship in respect to each other. Container 10 has a flat inner wall 14 with the remaining portion of the container 10 assuming a rounded bulbous configuration. Container 12 also has a flat inner wall 16 with again the remaining portion of the container assuming a rounded bulbous configuration. The walls 14 and 16 are to be located in a closely spaced arrangement with a planar wall member 18 located therebetween. The wall member 18 is basically in a shape of a flat plate. Flat inner wall 14 is to abut against one side of the wall 18 with flat inner wall 16 abutting against the opposite side of the wall 18.

The wall 18 is normally easily observable through each of the transparent containers 10 and 12. Therefore, it may be desirable to include on the wall 18 a series of indicia 19. A desirable form of such indicia 19 could be a representation of the quantity of liquid contained within the containers 10 and 12. If the amount of liquid contained in container 10 is only three cups and the server knows that at least four cups are needed, then the server knows to add some additional liquid to the container 10 before attempting to serve.

A normal material of construction for the wall 18 would be plastic. The forward edge of the wall 18 includes a V-shaped notch 20. The function of this notch will be explained further on in this specification. The rear edge of the wall 18 is formed into an integrally extending flange 22. This flange 22 is to be locatable in a close fitting manner within the recess 24 formed within a handle 26. Again, this handle 26 will normally be constructed of plastic material. The handle 26 will be permanently affixed to the flange 22 by means of a rivet 28.

Integrally connected to the handle 26 is a first band section 30. This band section 30 is basically semi-cylindrical in shape. The first band section 30 has a semi-cylindrical inner surface 32. Closely conforming to this surface 32 is a neck area 34 of the second container 12. This neck area 34 terminates at its upper end in an enlarged, smoothly contoured bead 36.

The approximate height of band section 30 will be generally no more than a couple of inches. The outer or free end of the band section 30 is formed into a lineal ridge 38. This ridge 38 is to occupy one-half of the notch 20.

There is incorporated a second band section 40 which is basically similar to band section 30 with the band sections 30 and 40 cooperating together to, in essence, form a single unitary band. The band section 40 has an internal semi-cylindrical wall 42. The neck section 44 of the container 10 is to abut against the wall 42 in a close conforming manner. The neck section 44 also terminates in an enlarged bead 46 which is located about the access opening into the container 10.

The band section 40 has at its outer or free end a lineal ridge 48. This lineal ridge 48 is also to fit within the notch 20 with this free end of the band section 40 abutting against the free end of the band section 30. The inner end of the band section 40 includes a hole 50. Through this hole 50 is conducted the rivet 28.

Initially, containers 10 and 12 are located side-by-side against the wall member 18. The band section 30 is placed in position about the neck section 34. The handle 26 will be in alignment with the gap area defined by the spacing between the flat inner walls 14 and 16. The ridge 38 is placed within the groove 20. Now the band section 40 is placed in position with the ridge 48 also placed within the groove 20. With the hole 50 in alignment with the hole 52 formed within the handle 26, the rivet 28 is then permanently installed. This means that the handle 26 and the band composed of band sections 30 and 40 are never disengaged from the containers 10 and 12. Generally, if one of the containers 10 or 12 is broken, this portion of the dispensing apparatus will be discarded and replaced with a new portion.

It is to be noted from the drawings that the band section 40 is shown to be of a different color than that of the band section 30. The reason for this is that the container 10 that is located directly adjacent the colored band section 40 is designed to contain a liquid different than that contained within the container 12. For example, the container 10 may be utilized to contain "decaffeinated" coffee, with the container 12 being adapted to contain "regular" coffee.

The uppermost section in each of the band sections 30 and 40 include a series of screw threading recesses 54. These recesses 54 are to engage in a screw threaded manner with screw threading protuberances 56. These protuberances 56 are formed within the wall of an internal chamber 58 of a valve housing 60. Mounted within the upper end of the chamber 58 is a valve member 62. Valve member 62 includes a hole 64 intermediate the length of the valve member 62. Formed integrally with the valve housing 60 is a pin 66. This pin 66 extends within the chamber 58 and is to fit within the hole 64. A portion of the valve member 62 protrudes exteriorly of the chamber 58 and is defined as a thumb contact section 68. In order for the valve member 62 to so protrude, there is provided an opening 80 through the wall of the valve housing 60. It is to be noted that with the valve housing 60 tightened down onto the band sections 30 and 40, the valve member 62 will be snugly held in position but is capable of being moved between the position shown in FIG. 5*a* to the position shown in FIG. 5*b* by the application of thumb pressure against the thumb contact area 68. This pressure will cause the valve member 62 to pivot substantially within a single plane about the pin 66.

Formed within the valve housing 60 is a spout 72. The inner end of the spout 72 is broken into two openings 74 and 76. These openings 74 and 76 are of the same size. Opening 74 is to connect only with the access opening 39 of container 10. Opening 76 is to connect only with the access opening 41 of container 12.

Figure 5:
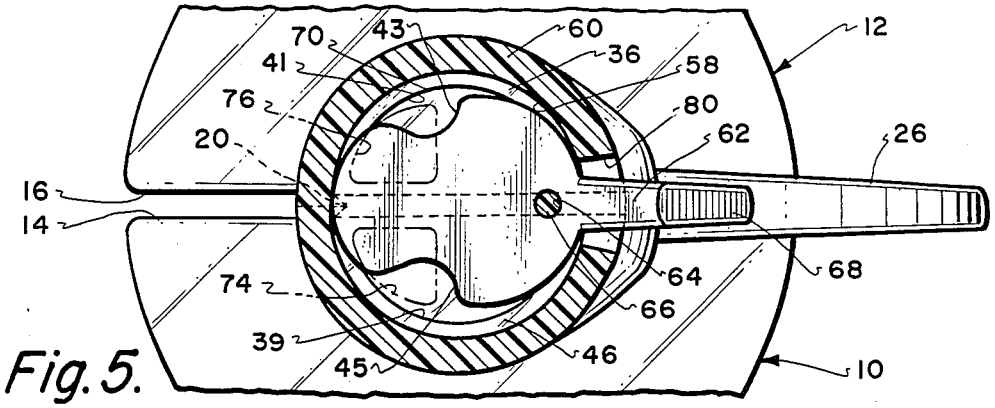
FIG. 5 is a cross-sectional view through the valve member of the dispensing apparatus of the present invention showing the valve member within the valve housing in a position between positions of normal usage.
Figure 5A:
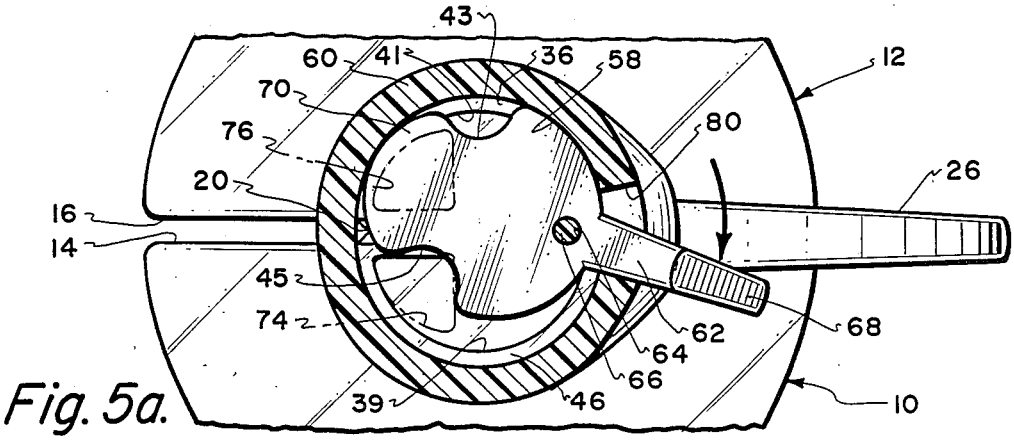
FIG. 5*a* is a view similar to FIG. 5 but showing the valve member in a position to dispense the contents of the first container.

With the valve member 62 in the position shown in FIG. 5*a* the enlarged end 70 of the valve member 62 will substantially cover the access opening 41 of the container 12 and prevent coffee or liquid from being conducted into the spout opening 76. Coffee will enter cutout section 43 but cannot exit therefrom. Upon movement of the dispensing apparatus to its normally carried position, any coffee in cutout section 43 will flow back into chamber 58

Figure 5B:
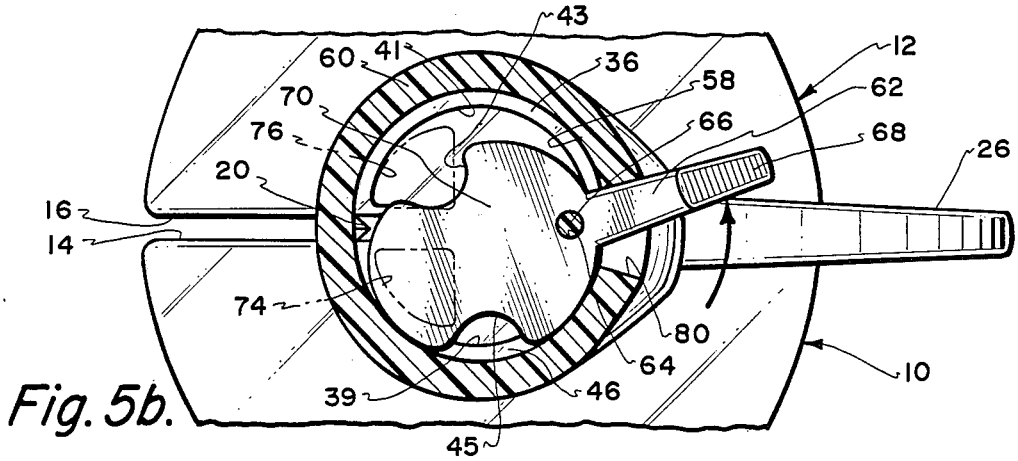
FIG. 5*b* is a view similar to FIG. 5 but showing the valve member in a position to dispense the contents of the second container.
Figure 6:
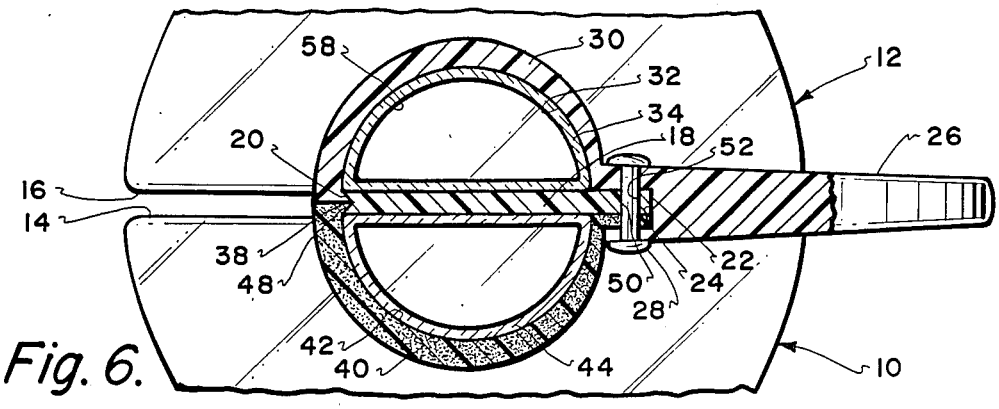
FIG. 6 is a cross-sectional view taken along line 6—6 of FIG. 3.

When valve member 62 is in the position shown in FIG. 5*b*, the enlarged end 70 will substantially cover the access opening 39 of the container 10 and will prevent coffee or liquid from the container 10 from being conducted into the spout opening 74. The cutout opening 45 will function in a manner similar to cutout opening 43. These cutout openings 43 and 45 are for the purpose of providing maximum flow through their respective spout openings 76 and 74.

When in the position of FIG. 5*a*, the coffee or liquid is capable of being conducted from the container 10, through the spout opening 74, and be poured into a cup or other type of container (not shown). In a similar manner, within FIG. 5*b*, coffee or liquid will be capable of being conducted from the container 12 into the spout opening 76 and also be poured from the spout 72 at the desired location.

Separating the spout openings 74 and 76 is a separating wall 78. With the valve member 62 in the position shown in FIG. 5, the enlarged end 70 will substantially cover both spout openings 74 and 76. This is of little significance, since the valve member 62 is not intended to be used in this position. The subject matter of the dispensing apparatus of this invention is to be used only with the valve member 62 in the positions shown in FIGS. 5*a* and 5*b*.

What is claimed is:

1. A coffee dispensing apparatus comprising:

a first container having a first access opening permitting entry and discharge of liquid into said first container;

a second container having a second access opening permitting entry and discharge of liquid into said second container, said second container located in close proximity to said first container with said first and second access openings in juxtaposition, said first container being identical to said second container, said second container being located in a side-by-side relationship with said first container;

means connecting together into a single unit said first container and said second container, said means being mounted directly onto said first and second containers;

a valve member mounted on said means, said valve member being pivotally movable substantially within a single plane between a first position and a second position between said first and second access openings, with said valve member in said first position said valve member closing said second access opening and the contents of said first container is capable of being disposed into the ambient with the contents of said second container not being dispensable, with said valve member in said second position said valve member closing said first access opening and the contents of said second container is capable of being dispensed into the ambient with the contents of said first container not being dispensable;

said valve member being mounted within a housing, said housing including a spout for directing of the contents of said first and second containers into the ambient during dispensing of said first and second containers, said housing being removably threadably secured to said means so said housing can be removed from said means to thereby facilitate cleaning of said valve member and said first and second containers;

a handle mounted on said means, said handle facilitating manual carrying of said dispensing apparatus;

said means comprising an encircling band assembly being permanently affixed to said first and second containers;

said band including indicia to visually differentiate said first container from said second container; and a wall member permanently affixed to said band, said wall member being located between said first and second containers, both said first and second containers being transparent, said wall member being of a length almost equal to the height of said first and second containers, said wall member including quantity determining indicia which is observable through said transparent walls of said first and second containers.

* * * * *